US007751582B2

(12) United States Patent
Akino

(10) Patent No.: US 7,751,582 B2
(45) Date of Patent: Jul. 6, 2010

(54) MICROPHONE WITH NARROW DIRECTIVITY

(75) Inventor: Hiroshi Akino, Machida (JP)

(73) Assignee: Kabushiki Kaisha Audio-Technica, Machida-shi (JP)

( * ) Notice: Subject to any disclaimer, the term of this patent is extended or adjusted under 35 U.S.C. 154(b) by 1099 days.

(21) Appl. No.: 11/416,201

(22) Filed: May 3, 2006

(65) Prior Publication Data

US 2006/0274913 A1 Dec. 7, 2006

(30) Foreign Application Priority Data

Jun. 3, 2005 (JP) ..... 2005-164313

(51) Int. Cl.
*H04R 25/00* (2006.01)

(52) U.S. Cl. ..... 381/337; 381/338; 381/369

(58) Field of Classification Search ..... 381/357–340, 381/355–359, 362, 369
See application file for complete search history.

(56) References Cited

U.S. PATENT DOCUMENTS 4,757,546 A 7/1988 Akino
4,789,044 A 12/1988 Akino
6,418,229 B1 * 7/2002 Staat ..... 381/357
6,681,023 B1 * 1/2004 Turnbull et al. ..... 381/369
2006/0078145 A1 4/2006 Akino

FOREIGN PATENT DOCUMENTS

JP 2000-83292 3/2000

* cited by examiner

*Primary Examiner*—Suhan Ni
(74) *Attorney, Agent, or Firm*—Oblon, Spivak, McClelland, Maier & Neustadt, L.L.P.

(57) ABSTRACT

A microphone with narrow directivity capable of obtaining high directivity and reducing wind noise is obtained. A cylindrical acoustic tube, a microphone unit arranged in the acoustic tube, a front acoustic chamber and a rear acoustic chamber formed by partitioning the acoustic tube by the microphone unit, a front acoustic terminal for causing the front acoustic chamber to communicate with an external space, a rear acoustic terminal for causing the rear acoustic chamber to communicate with an external space, and a film that covers the front acoustic terminal are comprised. It is recommended that the rear acoustic terminal be also covered with a film. Further, it is recommended that the films be made of vinyl chloride and formed into a corrugated shape.

8 Claims, 14 Drawing Sheets

MICROPHONE WITH NARROW DIRECTIVITY

BACKGROUND OF THE INVENTION

1. Field of the Invention

The present invention relates to a microphone with narrow directivity capable of efficiently reducing wind noise.

2. Related Background of the Invention

Conventionally, a general configuration for causing a microphone to have narrow directivity is a configuration using an acoustic tube. For example, such a configuration is used widely, in which the front end of an acoustic tube composed of a metal tube is used as an acoustic terminal and an opening provided in the circumferential wall of the acoustic tube is used as an acoustic resistor. Further, such a configuration is also used, in which an acoustic resistor is adhered to the opening. FIG. 5 shows an example of a conventional microphone with narrow directivity.

In FIG. 5, to one end (the right end in the figure) portion of a cylindrical acoustic tube 10, a microphone unit 14 is attached, and the other end portion of the acoustic tube 10 is an acoustic terminal 22. On the circumferential wall on further front side than the microphone unit 14 of the acoustic tube 10, a slit 18 to be an acoustic resistor is provided in parallel to the center axis line of the acoustic tube 10. As for sound waves from the directions other than the direction of the center axis line of the acoustic tube 10, the sound wave that enters the acoustic tube 10 through the acoustic terminal 22, which is the front end side of the acoustic tube 10, and the sound wave that enters the acoustic tube 10 through the slit 18 on the tube side interfere with each other to decrease the sound pressure level, and only the sound wave in the direction of the center axis line is converted into an electric signal in the microphone unit 14. This is the principle of a microphone with narrow directivity.

FIG. 6 shows a measurement result of the frequency characteristic of the above-mentioned conventional microphone with narrow directivity, wherein the horizontal axis represents the frequency (Hz) of sound wave and the vertical axis represents the output signal level (dBV). Based on the standards of Electronic Industries Association of Japan (hereinafter, referred to as "EIAJ"), with an output voltage at a specified frequency with a fixed sound pressure and a specified incidence angle under specified conditions being as a reference, the ratio of the reference output voltage to the output voltage by a sine wave signal is expressed in decibel as a function of the frequency. Hereinafter, the characteristic curves shown in FIGS. 2, 11, and 13 are also measured under the same conditions. A curve "a" shows the case where a location of a sound source is at 0 degree with respect to the center axis line of the acoustic tube, that is, just in front of the acoustic tube, a curve "b" shows the case where a location of the sound source is at 180 degrees with respect to the center axis line of the acoustic tube, that is, just behind the acoustic tube, and a curve "c" shows the case where a location of the sound source is at 90 degrees with respect to the center axis line of the acoustic tube, that is, just beside the acoustic tube. It can be said that the more distant the curves "b" and "c" become from the curve "a", the higher the directivity is. FIG. 7 shows the directivity of the above-mentioned conventional microphone with narrow directivity, wherein a scale of a concentric circle corresponds to 1 dB, and the vertical direction in the figure coincides with the longitudinal direction of the acoustic tube. The standards of EIAJ apply also to the measurement of the characteristic exhibiting the directivity as shown in FIG. 7, and the free sound field sensitivity of a microphone for a specified frequency or a narrow frequency band is expressed as a function of an incidence angle of a sound wave. FIGS. 3, 12, and 14 also show the measurement results performed under the same conditions. The frequency of the sound source is 1,000 Hz. As is seen from the measurement result in FIG. 7, the directivity is relatively excellent, that is, 133 degrees.

FIG. 8 shows the measurement result of wind noise of the above-mentioned conventional microphone with narrow directivity. The wind noise is a sound other than the sound to be captured originally, caused to occur when an air flow hits and passes over the acoustic tube, and belonging to a relatively low frequency region. The magnitude of wind noise is expressed by the equivalent sound pressure level by a wind in a state in which no sound field is present with respect to a wind the velocity and direction of which are specified according to the standards of EIAJ. Specifically, the generated voltage at a wind velocity of 2 m/s is measured and the equivalent sound pressure level at this time is obtained. Here, the characteristic shown in FIG. 4 is also measured under the same conditions. In FIG. 8, the horizontal axis represents the sound wave frequency (Hz) and the vertical axis represents the microphone output level (dB). As is seen from FIG. 8, there is a drawback that the wind noise level is high and an unpleasant low frequency noise is likely to mix in.

The applicants of the present invention applied for patent about a condenser microphone with narrow directivity in which acoustic terminals are provided in the front and in the rear of a microphone unit (for example, refer to a patent document 1). FIG. 9 is a diagram schematically showing the invention described in the patent document 1. In FIG. 9, the inside of the acoustic tube 10 is partitioned into a front acoustic chamber 11 and a rear acoustic chamber 13 by the microphone unit 14, and the front acoustic chamber 11 and the rear acoustic chamber 13 are acoustically connected by a gap 15 between the outer circumferential surface of the microphone unit 14 and the inner circumferential surface of the acoustic chamber. The front end of the above-mentioned front acoustic chamber 11 is opened and comes to be the acoustic terminal 22, and a circular hole opened in the side wall of the acoustic tube 10 constituting the rear acoustic chamber 13 comes to be an acoustic terminal 24. Since the microphone is configured such that the above-mentioned gap 15 functions as acoustic impedance and the acoustic terminals 22 and 24 in the front and in the rear of the microphone unit 14 are short-circuited by the above-mentioned acoustic impedance, a sound wave of extremely low frequency such as wind noise can be reduced.

The longer an acoustic tube is, the higher the directivity becomes. On the other hand, a vibration noise of a microphone with narrow directivity depends on the mass of air in the acoustic tube, and the longer the acoustic tube, the more the mass of the air in the acoustic tube increases, thereby increasing the vibration noise as well. However, according to the invention described in the patent document 1, since the acoustic terminals in the front and in the rear of the microphone unit are short-circuited by the above-mentioned impedance, it is also possible to reduce the vibration noise.

However, there is a drawback that when an air flow hits the acoustic terminal 22 at the front end of the acoustic tube 10, low frequency wind noise is produced and unpleasant "gurgling" noise is output because the level of the frequency region of the wind noise is large. It is conceivable that the low frequency response of a microphone is electrically reduced by using a low cut circuit as a means for reducing such wind noise. However, if a low cut circuit is used, the diaphragm of the microphone unit vibrates at a low frequency due to wind, therefore, it is difficult to avoid sound modulated with a low frequency from being output. Therefore, in an extreme case, sound may be intermittent accompanied by a "gurgling" wind noise.

As described above, it is difficult to reduce wind noise while obtaining narrow directivity and various proposals have been presented in addition to the invention described in the patent document 1. For example, an attempt is made in which an acoustic resistor is attached to the acoustic terminal on the front side of an acoustic tube or the acoustic terminal on the front side is closed. FIG. 10 shows still another example of a conventional microphone with narrow directivity. In FIG. 10, the inside of the acoustic tube 10 is partitioned into the front acoustic chamber 11 and the rear acoustic chamber 13 by a unit holder 12 holding the microphone unit 14. The front end of the above-mentioned front acoustic chamber 11 is opened and comes to be the acoustic terminal 22 and the circular hole opened in the side wall of the acoustic tube 10 constituting the rear acoustic chamber 13 also comes to be the acoustic terminal 24. In the tube wall of the acoustic tube 10, at least one straight slit 18 is formed in parallel to the center axis line of the acoustic tube 10 on the front acoustic chamber 11 side. The slit 18 is covered with an acoustic resistor 20 adhered to the outer circumferential surface of the acoustic tube 10. The acoustic resistor 20 is made of cloth, non-woven fabric cloth, film, etc. Although not shown in FIG. 10, there may be the case where the acoustic terminal 22 on the front side is also covered with an acoustic resistor or the acoustic terminal 22 is closed.

FIG. 11 shows the measurement result of the output signal level (dBV) for the sound frequency (Hz) in the configuration as shown in FIG. 10, in which an acoustic resistor is attached to the acoustic terminal 22 at the front end of the acoustic tube 10. Similarly to the case shown in FIG. 6, a curve "a" shows the case where the location of a sound source is at 0 degree with respect to the center axis line of the acoustic tube, that is, just in front of the acoustic tube, a curve "b" shows the case where the location of a sound source is at 180 degrees with respect to the center axis line of the acoustic tube, that is, just behind the acoustic tube, and a curve "c" shows the case where the location of a sound source is at 90 degrees with respect to the center axis line of the acoustic tube, that is, just beside the acoustic tube. As is seen from the measurement result, in comparison with FIG. 6 that shows the measurement result of the conventional example shown in FIG. 5, the sensitivity drops on the contrary and the high frequency sound region is degraded. FIG. 12 shows the measurement result of the directivity of the one having such a configuration as shown in FIG. 10 in accordance with FIG. 7. As is seen from FIG. 12, the directivity is also degraded in comparison with the conventional example shown in FIG. 5.

FIG. 13 shows the measurement result of the output signal level (dBV) for the sound frequency (Hz) in the configuration as shown in FIG. 10, in which the acoustic terminal 22 at the front end of the acoustic tube 10 is closed in accordance with FIG. 6. As is seen from this measurement result, the sensitivity and the directional frequency response in the sound band are degraded. Further, FIG. 14 shows the measurement result of directivity in the above-mentioned configuration in accordance with FIG. 12. As is seen from FIG. 14, the sound level that enters from the rear side increases and the directivity is also degraded.

[Patent document 1] Japanese Patent Application Laid-Open No. 2000-83292

SUMMARY OF THE INVENTION

The present invention has been developed in order to solve the problems of the conventional microphone with narrow directivity described above and an object thereof is to provide a microphone with narrow directivity capable of obtaining high directivity and reducing wind noise.

The present invention is mainly characterized by comprising a cylindrical acoustic tube, a microphone unit arranged in the acoustic tube, a front acoustic chamber and a rear acoustic chamber formed by partitioning the above-mentioned acoustic tube by the microphone unit, a front acoustic terminal for causing the front acoustic chamber to communicate with an external space, a rear acoustic terminal for causing the rear acoustic chamber to communicate with an external space, and a film for covering the above-mentioned acoustic terminal.

The rear acoustic terminal may also be covered with the film.

It is recommended that the film be made of vinyl chloride and formed into a corrugated shape.

The film that covers the front acoustic terminal acts as a diaphragm and allows a high frequency sound wave to pass but not a low frequency sound wave because of its stiffness. Further, the above-mentioned film is capable of preventing an air flow from entering or going out by wind. Therefore, it is possible to prevent degradation in sound quality due to wind noise and an unpleasant feeling due to wind noise without the microphone's picking up wind noise. If a film made of vinyl chloride and formed into a corrugated shape is used, it is possible to more efficiently reduce wind noise.

BRIEF DESCRIPTION OF THE DRAWINGS

FIG. 11 is a characteristic diagram showing a frequency characteristic of the conventional microphone with narrow directivity.

FIG. 12 is a characteristic diagram showing a directivity of the conventional microphone with narrow directivity.

FIG. 13 is a characteristic diagram showing a frequency characteristic of the conventional microphone with narrow directivity.

FIG. 14 is a characteristic diagram showing a directivity of the conventional microphone with narrow directivity.

DESCRIPTION OF THE PREFERRED EMBODIMENTS

Embodiments of a microphone with narrow directivity according to the present invention are described below with reference to FIGS. 1(*a*) to 4. Here, the same symbols are attached to the same components as those in the configuration of the conventional example explained above.

Figure 1:
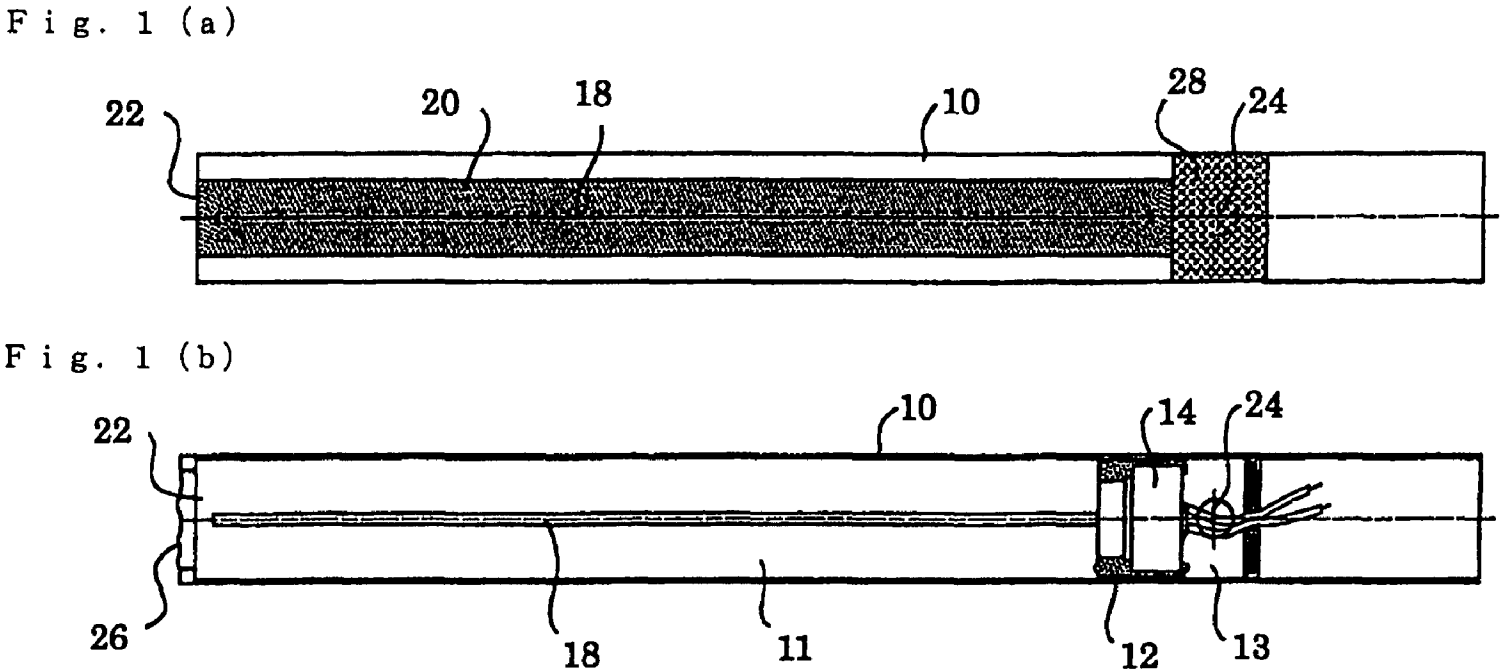
FIGS. 1(*a*) and 1(*b*) show an embodiment of a microphone with narrow directivity according to the present invention, wherein FIG. 1(*a*) is a front view and FIG. 1(*b*) is a longitudinal sectional view.

In FIG. 1, symbol 10 denotes an acoustic tube made of an elongated cylindrical member. The acoustic tube 10 may be formed from a metal cylinder or a resin cylinder. The inside of the acoustic tube 10 is partitioned into a front acoustic chamber 11 and a rear acoustic chamber 13 by a unit holder 12 holding a microphone unit 14. The microphone unit 14 is arranged near the rear end (the right end in FIG. 1) of the acoustic tube 10 and the front acoustic chamber 11 is considerably longer than the rear acoustic chamber 13. The front end of the front acoustic chamber 11 is opened and comes to be a front acoustic terminal 22 for causing the front acoustic chamber 11 to communicate with an external space. In the side wall of the acoustic tube 10 constituting the rear acoustic chamber 13, a circular hole is opened and the circular hole comes to be a rear acoustic terminal 24 for causing the rear acoustic chamber 13 to communicate with an external space. In the tube wall of the acoustic tube 10, at least one straight slit 18 is formed in parallel to the center axis line of the acoustic tube 10 on the front acoustic chamber 11 side. The slit 18 is covered with an acoustic resistor 20 adhered to the outer circumferential surface of the acoustic tube 10. The acoustic resistor 20 is made of cloth, non-woven fabric cloth, film, etc. The acoustic resistor 20 may be adhered to the outer circumferential surface side of the acoustic tube 10 or to the inner circumferential surface side thereof.

The opening at the front end of the acoustic tube 10 is covered with a film 26. Therefore, the front acoustic terminal 22 is covered with the film 26. At the portion where the rear acoustic terminal 24 is located, a film 28 is wound around the outer circumferential surface of the acoustic tube 10 and the rear acoustic terminal 24 is covered with the film 28. The films 26 and 28 are made of plastic. In the embodiment, a film made of vinyl chloride having a thickness of 30 μm was used. Then, it is recommended that it be formed into a corrugated shape in order to prevent resonance. Further, it is recommended that the pitch (interval) of the corrugation be set to about 0.2 to 1 mm. In the embodiment shown in FIG. 1, both the front acoustic terminal 22 and the rear acoustic terminal 24 are covered with the films 26 and 28, however, only the front acoustic terminal 22 may be covered with the film 26.

According to the embodiment shown in FIG. 1, due to the fact that the acoustic terminals 22 and 24 located in the front and in the rear of the acoustic tube 10 are covered with the films 26 and 28 made of vinyl chloride, the films 26 and 28 operate as a diaphragm and resonate with a sound, in particular, a low frequency sound. Further, since the films 26 and 28 have stiffness, a low frequency sound wave is not allowed to pass but a high frequency sound wave is allowed to pass. In addition, it is also possible to prevent air from entering or going out due by wind. As a result, wind noise is prevented from mixing into a signal to be converted by a microphone unit and it is possible to prevent the sound from being interrupted with an unpleasant "gurgling" sound.

Figure 2:
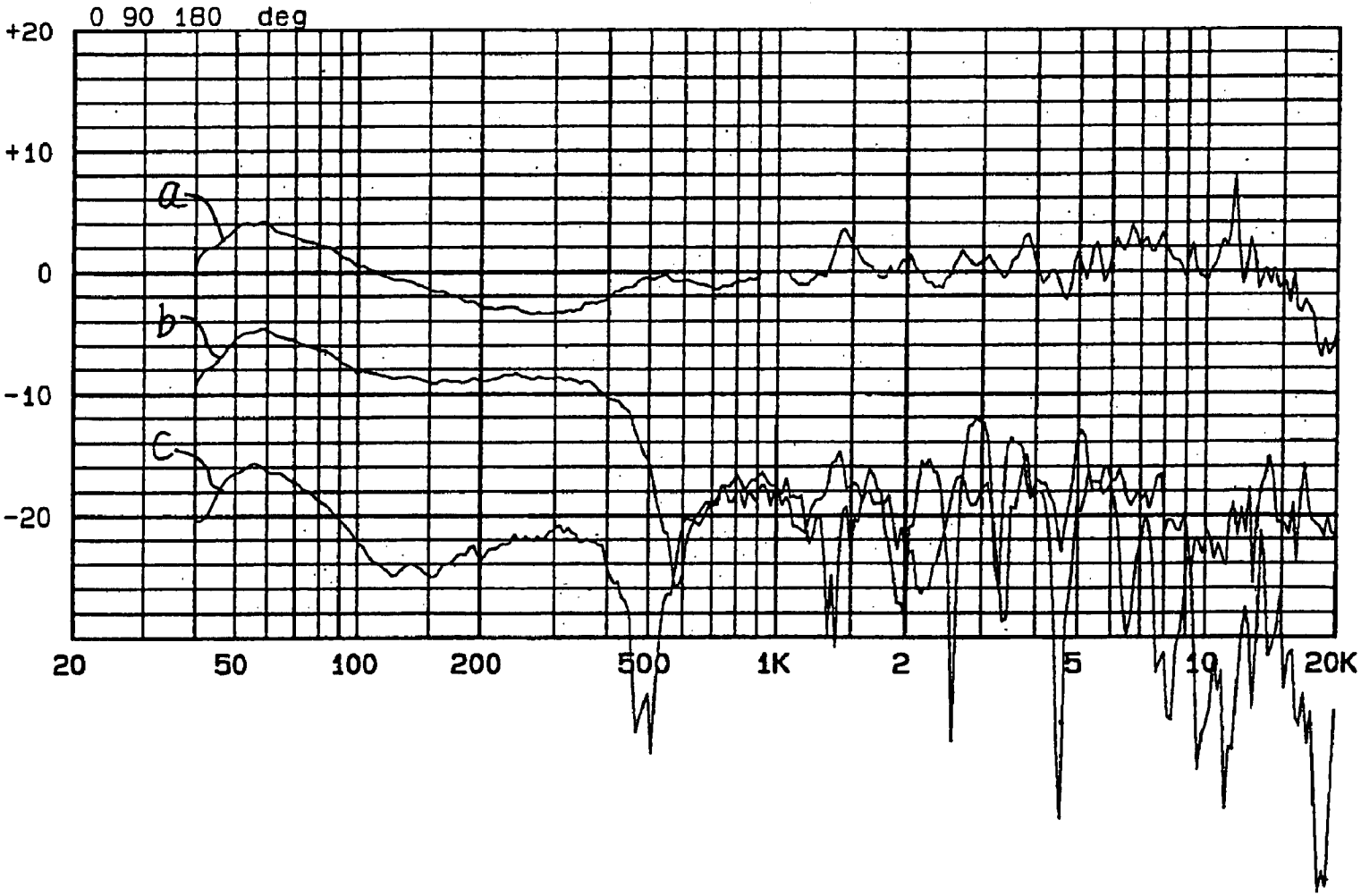
FIG. 2 is a characteristic diagram showing a frequency characteristic of the microphone with narrow directivity according to the embodiment.
Figure 6:
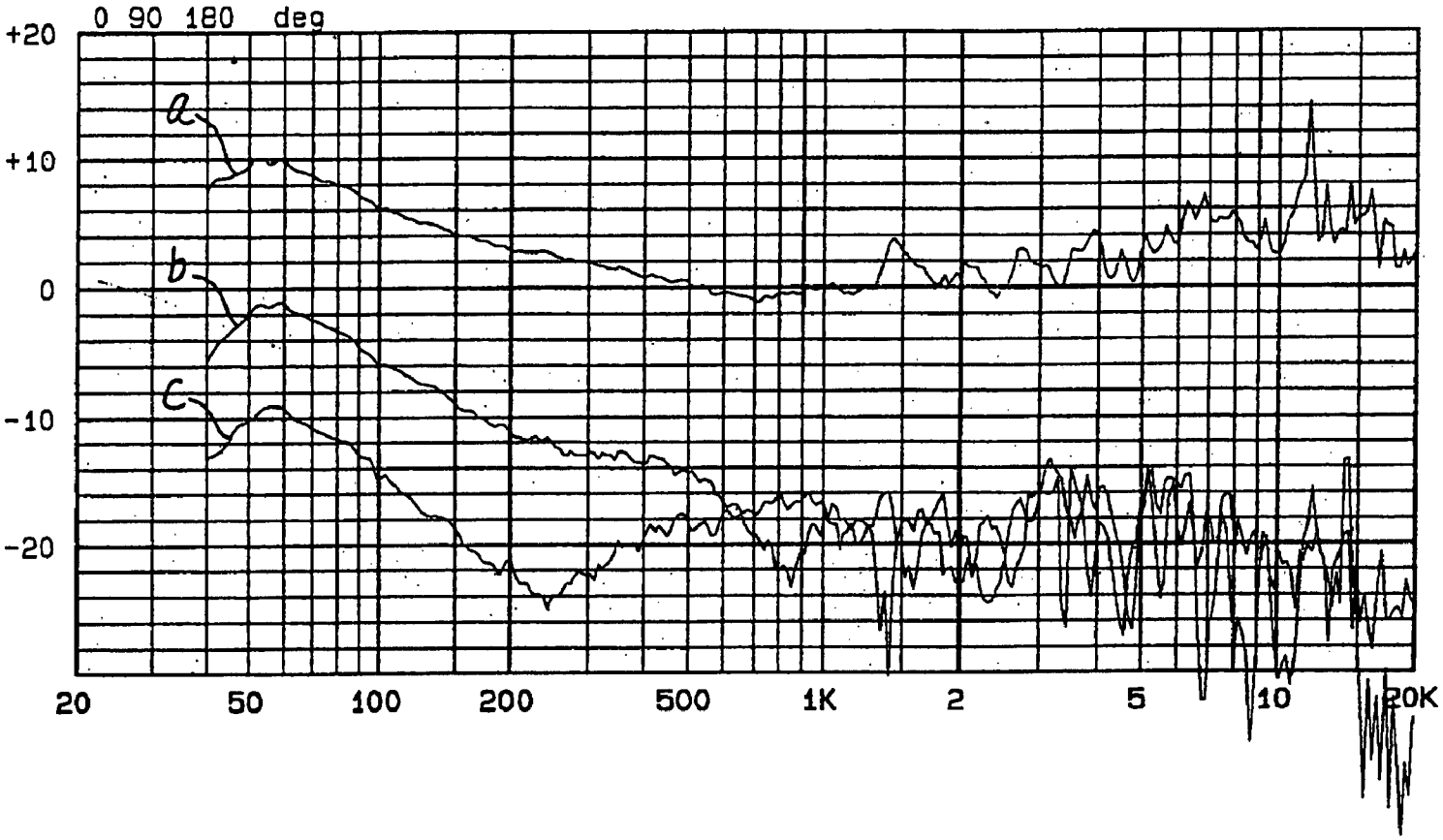
Fig. 6 (RELATED ART)
FIG. 6 is a characteristic diagram showing a frequency characteristic of the conventional microphone with narrow directivity.

FIG. 2 shows the measurement result of the frequency characteristic in the embodiment shown in FIG. 1, wherein the horizontal axis represents the sound wave frequency (Hz) and the vertical axis represents the output signal level (dBV). A curve "a" shows the case where the location of a sound source is at 0 degree with respect to the center axis line of the acoustic tube, that is, just in front of the acoustic tube, a curve "b" shows the case where the location of a sound source is at 180 degrees with respect to the center axis line of the acoustic tube, that is, just behind the acoustic tube, and a curve "c" shows the case where the location of a sound source is at 90 degrees with respect to the center axis line of the acoustic tube, that is, just beside the acoustic tube. In comparison with FIGS. 6, 11, and 13 that show the frequency characteristic in each of the conventional examples, the level drops by about 3 to 10 dB at a frequency equal to or less than 100 Hz, at which wind noise is large in particular. It is found that the wind noise is reduced accordingly. Since wind noise is non-correlated noise, it is made possible to reduce wind noise by a factor of ½ to 1/10. Further, in a region in which the frequency of a sound wave exceeds 500 Hz, the curves "b" and "c" are more distant from the curve "a" and according to the embodiment, it can be said that the directivity is increased.

Figure 3:
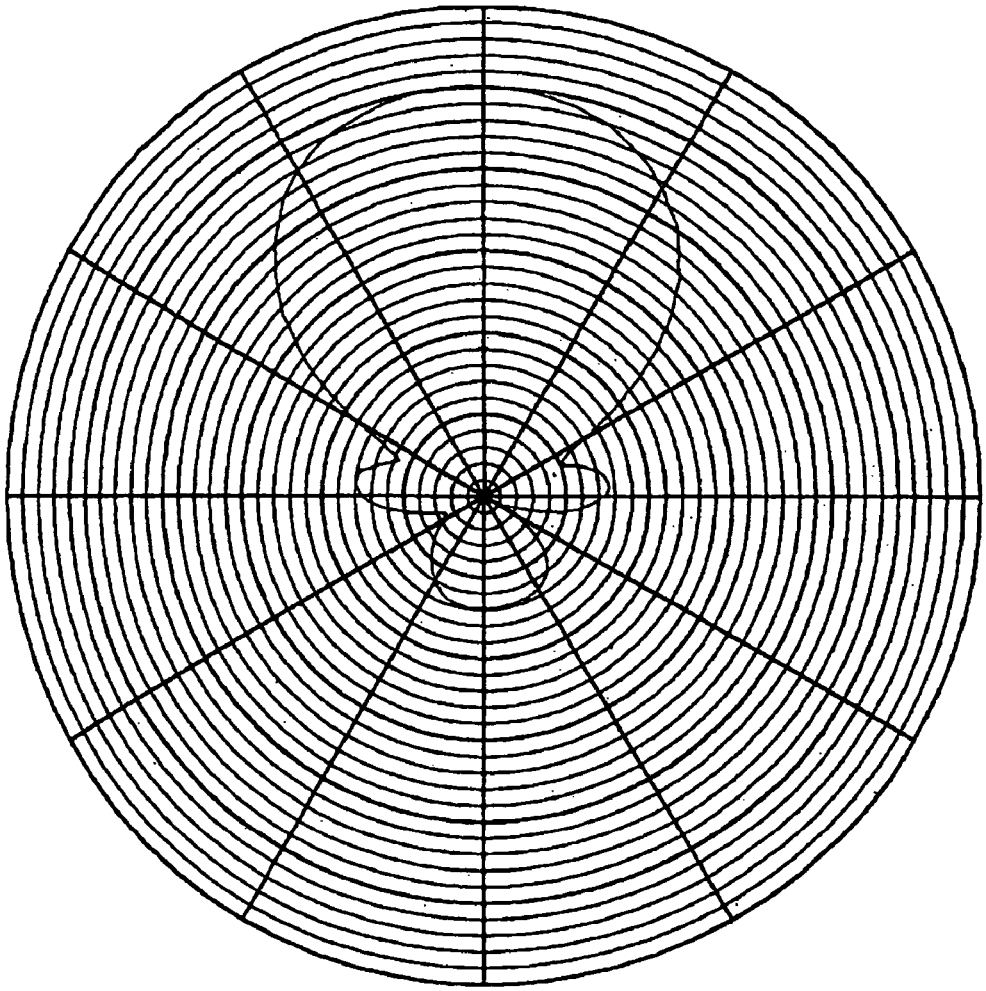
FIG. 3 is a characteristic diagram showing a directivity of the microphone with narrow directivity according to the embodiment.
Figure 7:
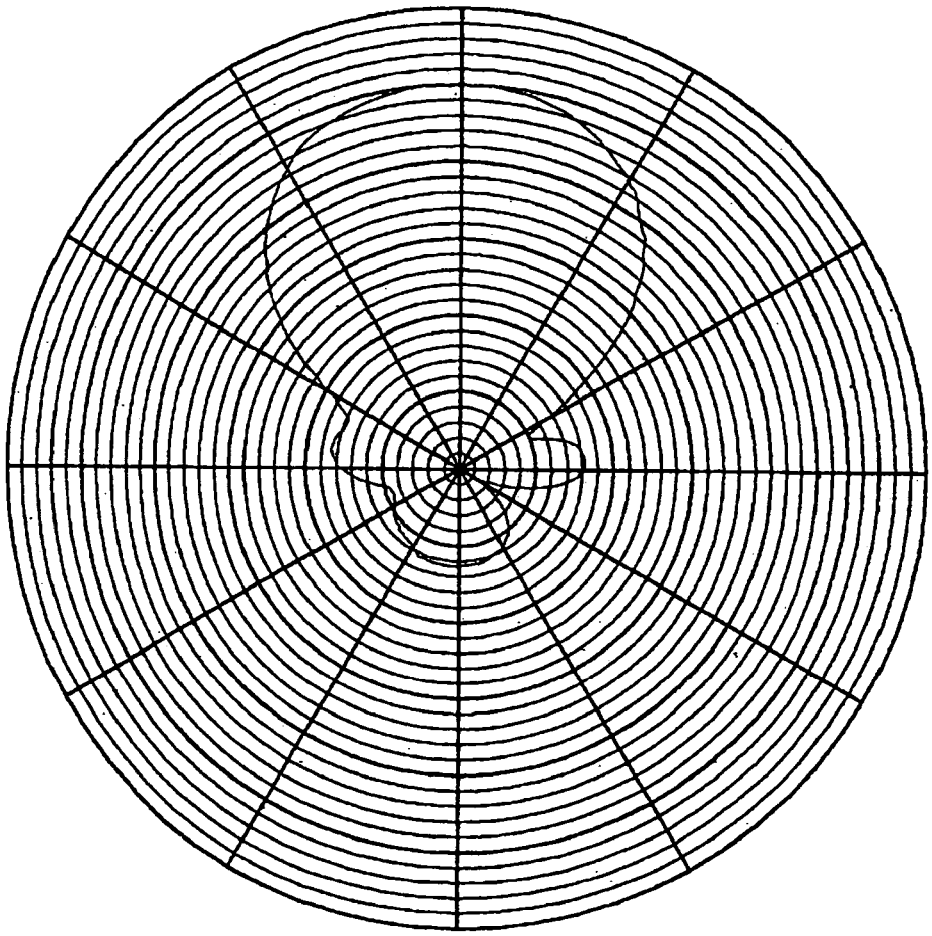
Fig. 7 (RELATED ART)
FIG. 7 is a characteristic diagram showing a directivity of the conventional microphone with narrow directivity.

FIG. 3 shows the directivity of the microphone with narrow directivity according to the embodiment in accordance with FIG. 7 etc. and a scale of a concentric circle corresponds to 1 dB and the vertical direction in the figure coincides with the longitudinal direction of the acoustic tube. The frequency of the sound source is 1,000 Hz. As is seen from FIG. 3, the output level of the sound waves from the rear direction and the transverse direction are suppressed properly and an excellent directivity is shown. Incidentally, the directional angle is 133 degrees.

Figure 4:
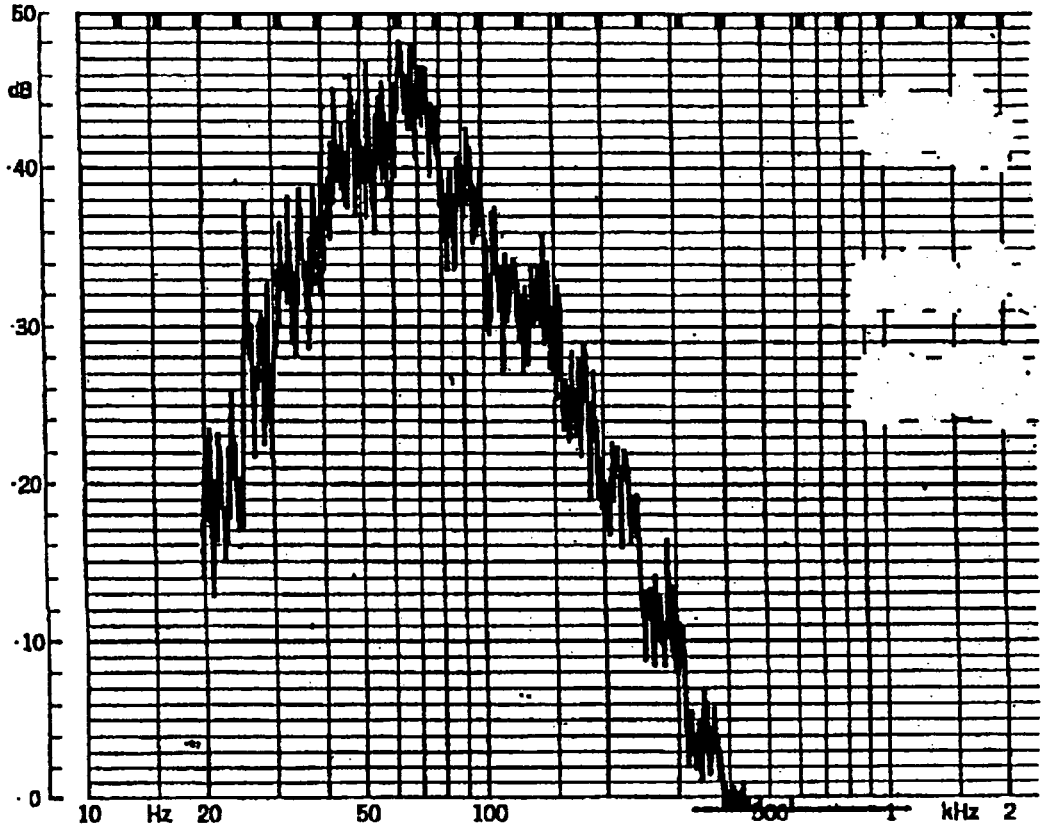
FIG. 4 is a characteristic diagram showing a measurement result of wind noise of the microphone with narrow directivity according to the embodiment.
Figure 5:
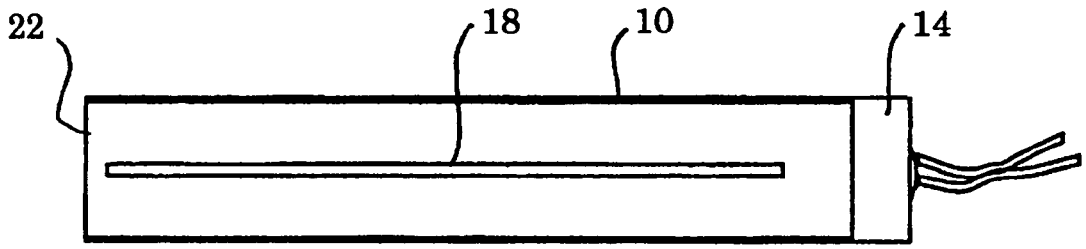
Fig. 5 (RELATED ART)
FIG. 5 is a longitudinal sectional view showing an example of a conventional microphone with narrow directivity.
Figure 8:
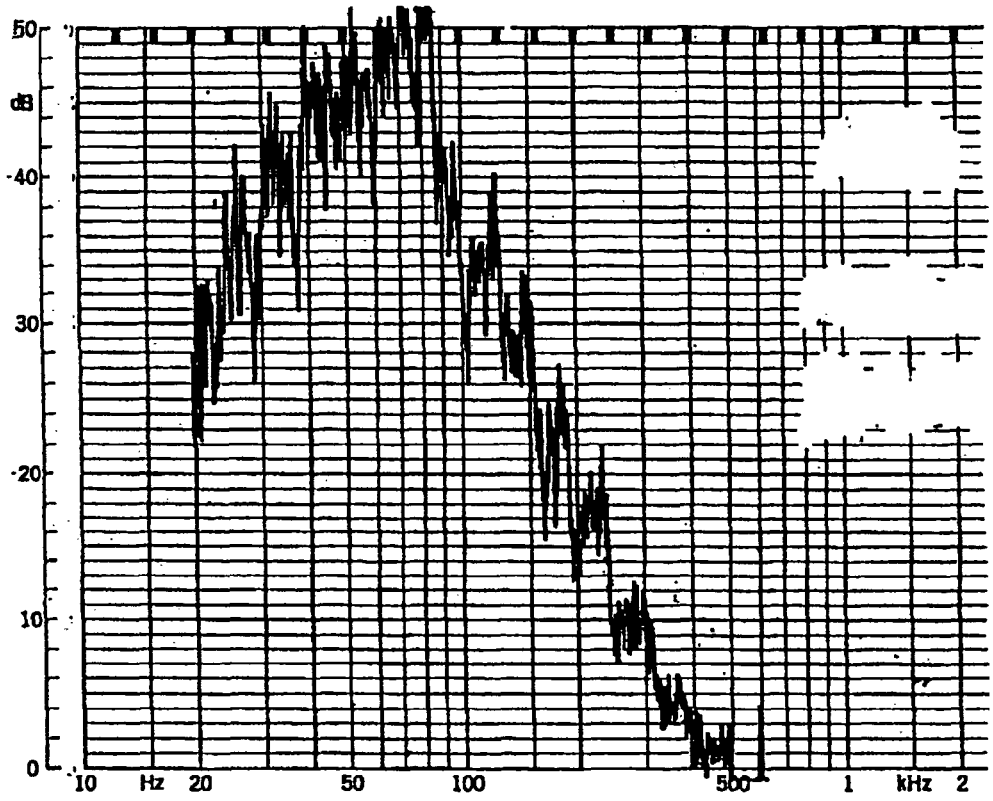
Fig. 8 (RELATED ART)
FIG. 8 is a characteristic diagram showing a measurement result of wind noise of the conventional microphone with narrow directivity.
Figure 9:
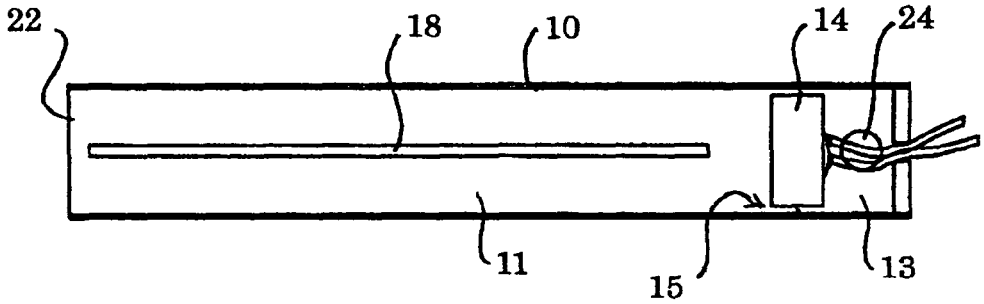
Fig. 9 (RELATED ART)
FIG. 9 is a longitudinal sectional diagram showing another example of a conventional microphone with narrow directivity.
Figures 1, 10:
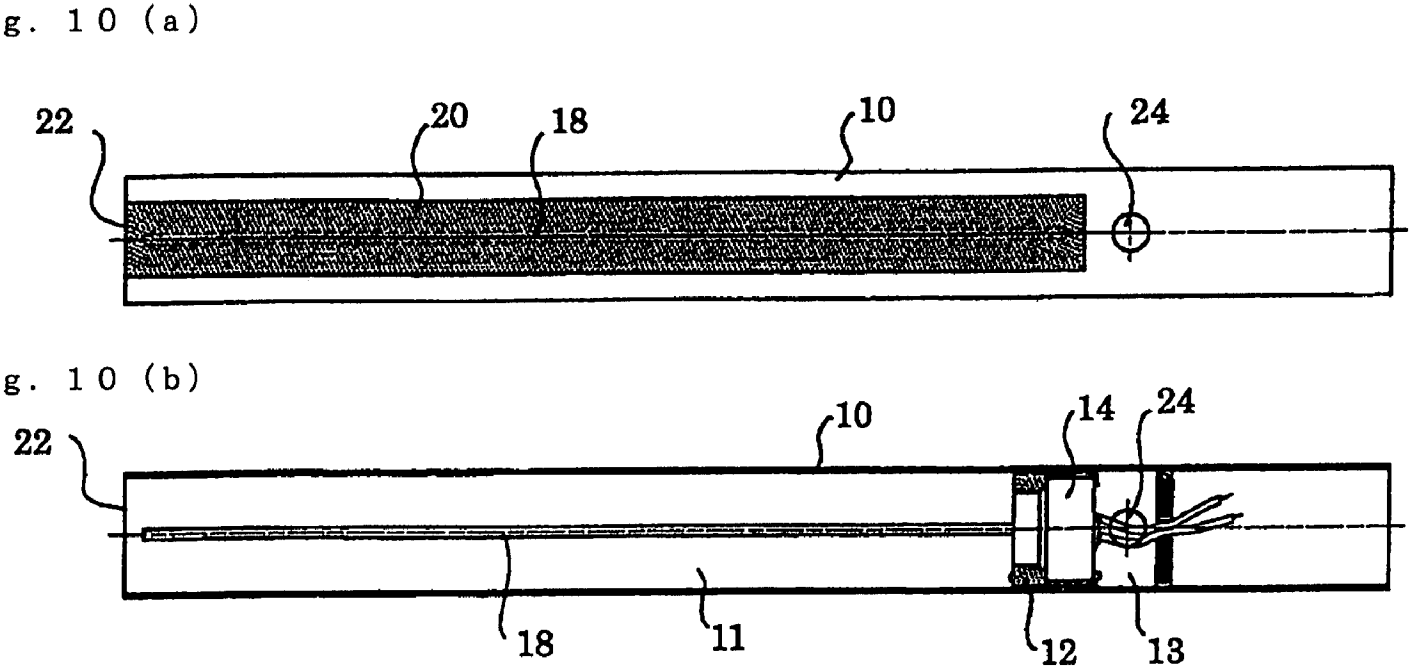
Fig. 1 0 (RELATED ART)
FIGS. 10(*a*) and 10(*b*) show another example of a conventional microphone with narrow directivity, wherein FIG. 10(*a*) is a front view and FIG. 10(*b*) is a longitudinal sectional view.
Figure 1:
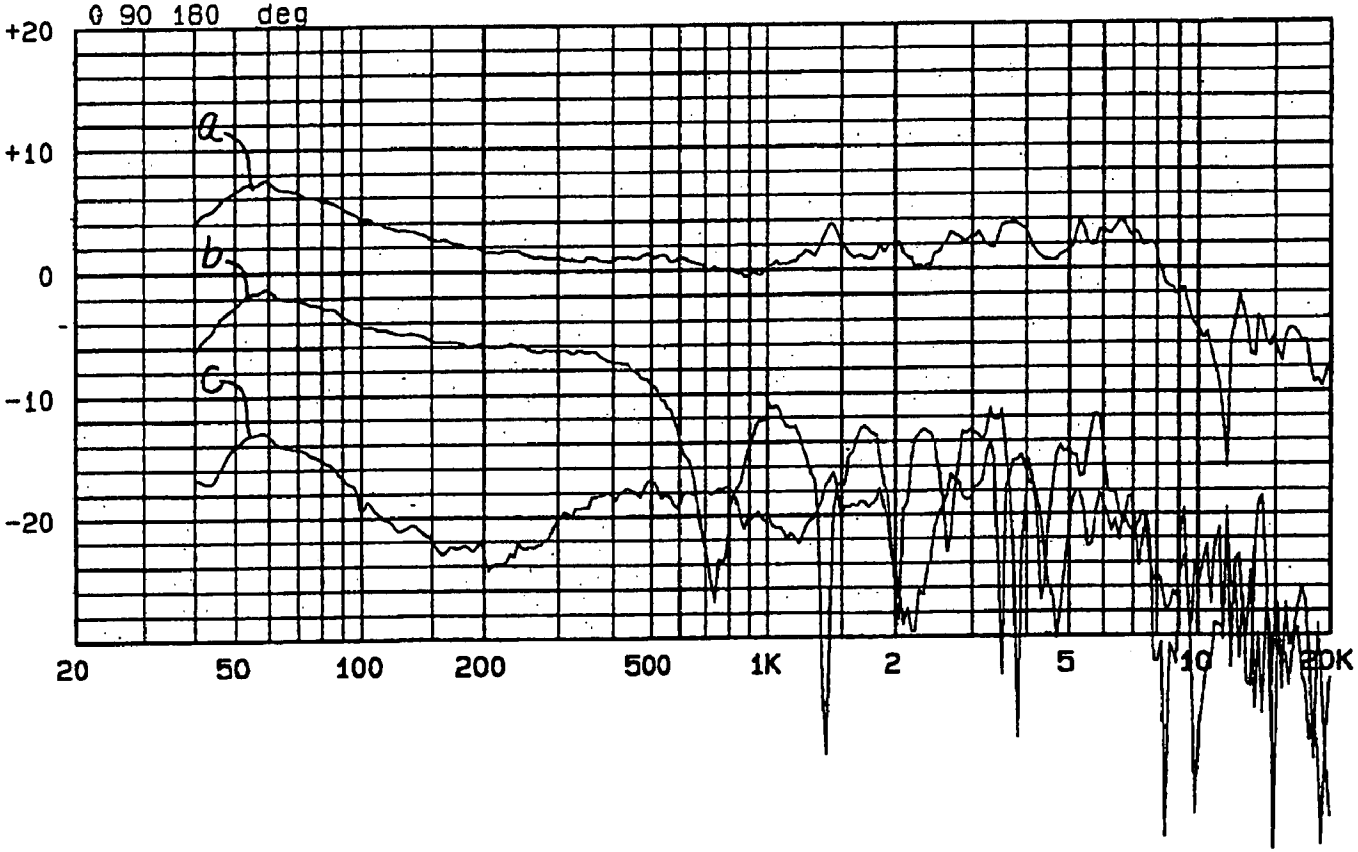
Fig. 1 1 (RELATED ART)
Figure 1:
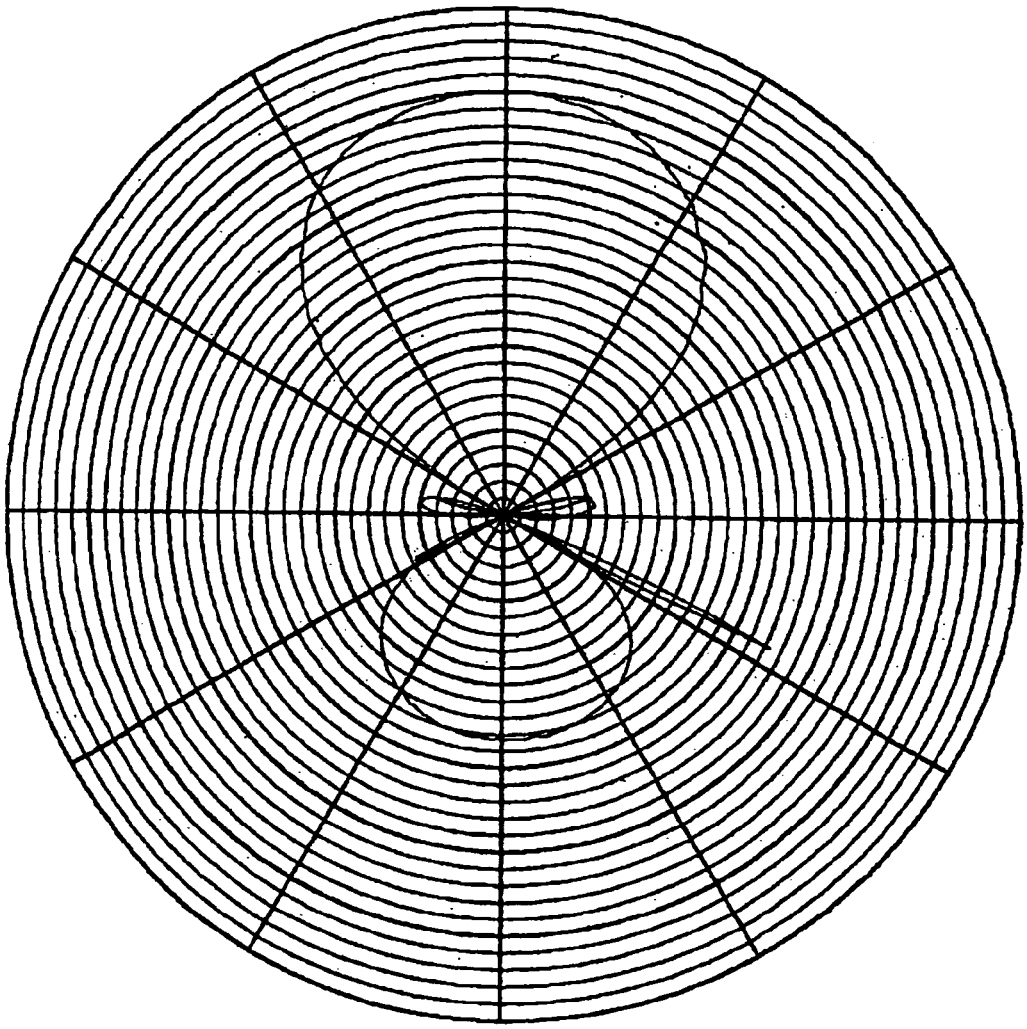
Fig. 1 2 (RELATED ART)
Figure 1:
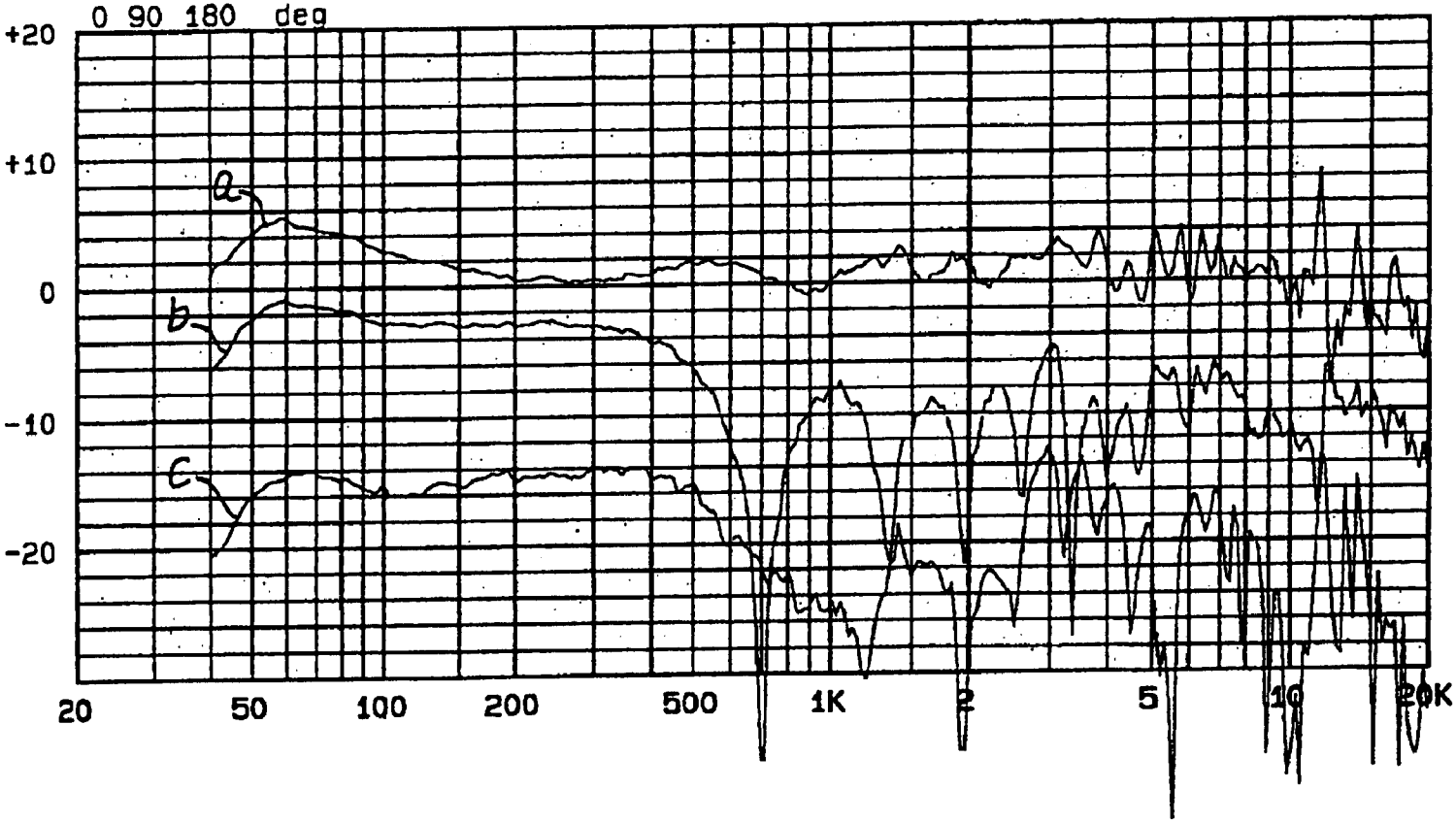
Fig. 1 3 (RELATED ART)
Figure 1:
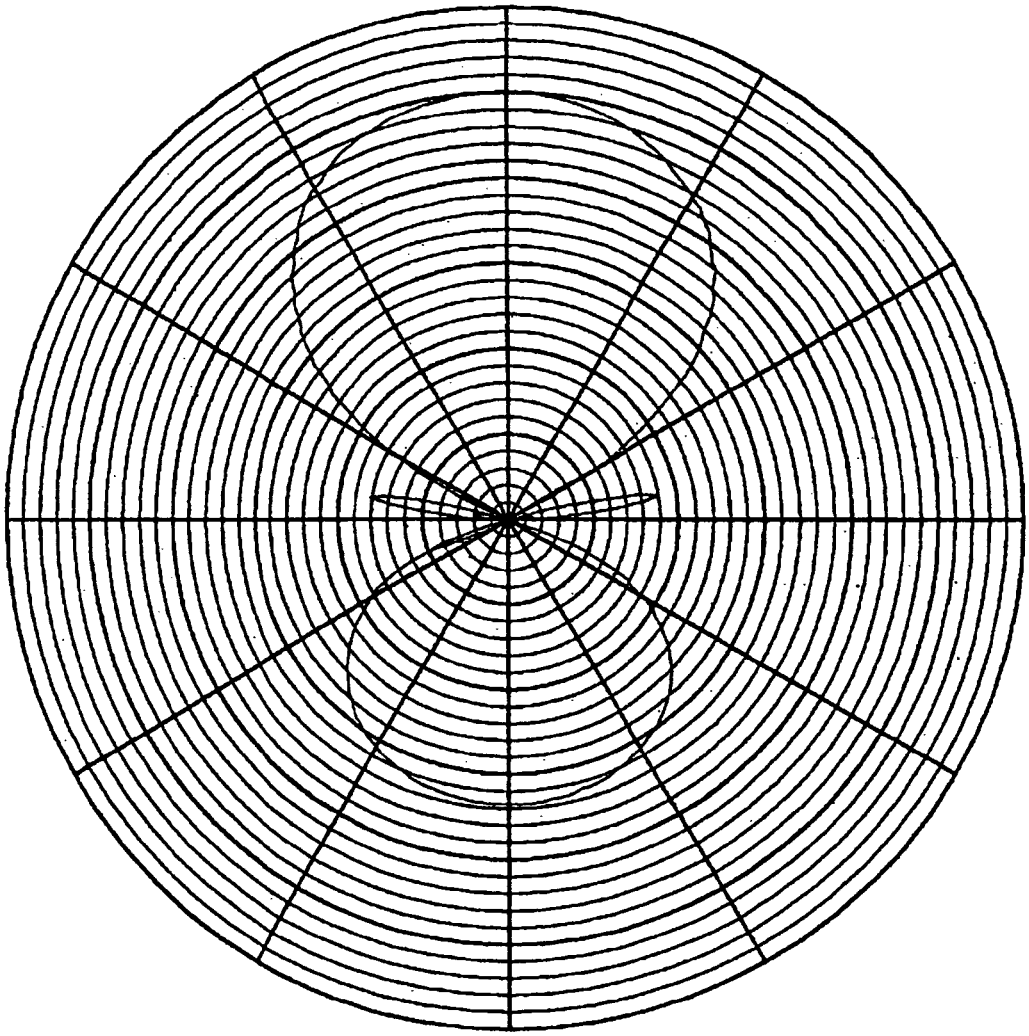
Fig. 1 4 (RELATED ART)

FIG. 4 shows the measurement result of the wind noise of the microphone with narrow directivity according to the embodiment performed in accordance with the measurement result shown in FIG. 8. In FIG. 4, the horizontal axis represents the sound wave frequency (Hz) and the vertical axis represents the output level (dB) of the microphone. As is seen from comparison between FIG. 4 and FIG. 8, the level of the wind noise is lowered and the level of unpleasant noise in a low frequency is lowered.

According to the embodiment of the microphone with narrow directivity of the present invention, in addition to the effects described above, there is an effect that penetration of water can be prevented from entering the inside of the microphone because the acoustic terminal is covered with the film and the drops of liquid such as raindrops are blocked by the film.

According to the present invention, it is possible to effectively reduce wind noise by covering both a front acoustic terminal and a rear acoustic terminal with a film and it is only required that at least the front acoustic terminal be covered with the film, and even if the rear acoustic terminal is not covered with the film, it is possible to more effectively reduce wind noise than the conventional microphone with narrow directivity.

What is claimed is:

1. A microphone with narrow directivity comprising:

a cylindrical acoustic tube;

a microphone unit arranged in the acoustic tube;

a front acoustic chamber and a rear acoustic chamber formed by partitioning the acoustic tube by the microphone unit;

a front acoustic terminal for causing the front acoustic chamber to communicate with an external space, wherein the front acoustic terminal is a front end opening of the acoustic tube;

a rear acoustic terminal for causing the rear acoustic chamber to communicate with an external space, wherein the rear acoustic terminal is a hole formed in the side wall constituting the acoustic tube and is also covered with a film; and a film that covers the front acoustic terminal.

2. A microphone with narrow directivity comprising:

a cylindrical acoustic tube;

a microphone unit arranged in the acoustic tube;

a front acoustic chamber and a rear acoustic chamber formed by partitioning the acoustic tube by the microphone unit;

a front acoustic terminal for causing the front acoustic chamber to communicate with an external space, wherein the front acoustic terminal is a front end opening of the acoustic tube;

a rear acoustic terminal for causing the rear acoustic chamber to communicate with an external space, wherein the rear acoustic terminal is a hole formed in the side wall constituting the acoustic tube and is also covered with a film; and a film that covers the front acoustic terminal, wherein the film is made of vinyl chloride and is formed into a corrugated shape.

3. A microphone with narrow directivity comprising:

a cylindrical acoustic tube having an acoustic resistor arranged to suppress the sound pressure in the acoustic tube of sounds originating in directions other than a longitudinal direction of the acoustic tube, whereby the acoustic tube has narrow directivity;

a microphone unit arranged in the acoustic tube;

a front acoustic chamber and a rear acoustic chamber formed by partitioning the acoustic tube by the microphone unit;

a front acoustic terminal for causing the front acoustic chamber to communicate with an external space;

a rear acoustic terminal for causing the rear acoustic chamber to communicate with an external space; and a film that covers the front acoustic terminal, wherein the film is formed of a material that selectively and preferentially absorbs sounds in a frequency of sound produced by wind.

4. The microphone with narrow directivity according to claim 3, wherein the rear acoustic terminal is also covered with a film.

5. The microphone with narrow directivity according to claim 3, wherein the film is made of vinyl chloride.

6. The microphone with narrow directivity according to claim 5, wherein the film made of vinyl chloride is formed into a corrugated shape.

7. The microphone with narrow directivity according to claim 3, wherein the front acoustic terminal is a front end opening of the acoustic tube.

8. The microphone with narrow directivity according to claim 3, wherein the rear acoustic terminal is a hole formed in the side wall constituting the acoustic tube.

* * * * *